US006235703B1

(12) United States Patent
Appel et al.

(10) Patent No.: US 6,235,703 B1
(45) **Date of Patent: *May 22, 2001**

(54) SURFACTANT BLENDS, PROCESSES FOR PREPARING THEM AND PARTICULATE DETERGENT COMPOSITIONS CONTAINING THEM

(75) Inventors: Peter Willem Appel, Rotterdam; Huig Euser, Vlaardingen; Hendricus Anthonius Rebers, Schiedam; Cornelis Gerhard van Kralingen, Barendrecht, all of (NL)

(73) Assignee: Lever Brothers, division of Conopco, Inc., New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/829,106

(22) Filed: Apr. 1, 1997

(30) Foreign Application Priority Data

Apr. 2, 1996 (GB) ..... 9606913

(51) Int. Cl.[7] ..... C11D 1/825; C11D 11/00; C11D 17/06; C11D 3/12

(52) U.S. Cl. ..... 510/444; 510/421; 510/457; 510/470

(58) Field of Search ..... 510/444, 470, 510/457, 421

(56) References Cited

U.S. PATENT DOCUMENTS

| | | | | |
|---|---|---|---|---|
| 4,083,813 | * | 4/1978 | Wise et al. | 510/347 |
| 4,536,319 | | 8/1985 | Payne | 252/174.17 |
| 4,780,250 | * | 10/1988 | Urfer et al. | 510/470 |
| 4,804,497 | * | 2/1989 | Urfer et al. | 510/331 |
| 4,820,439 | | 4/1989 | Rieck | 252/135 |
| 4,990,605 | | 2/1991 | Lueders et al. | 536/18.5 |
| 5,043,091 | * | 8/1991 | Jushi et al. | 510/470 |
| 5,152,932 | * | 10/1992 | Mueller et al. | 510/443 |
| 5,205,959 | | 4/1993 | Schmid | 252/174.17 |
| 5,318,733 | * | 6/1994 | Carduct et al. | 264/15 |
| 5,519,948 | * | 5/1996 | Raehse et al. | 33/347 |
| 5,536,431 | | 7/1996 | Carduck et al. | 510/444 |
| 5,565,419 | * | 10/1996 | Thomas et al. | 510/197 |
| 5,587,104 | * | 12/1996 | Zeise et al. | 510/298 |
| 5,599,476 | | 2/1997 | Behler et al. | 510/135 |
| 5,698,510 | * | 12/1997 | Wilkinson et al. | 510/444 |
| 5,736,501 | * | 4/1998 | Yamashita et al. | 510/444 |

FOREIGN PATENT DOCUMENTS

| | | |
|---|---|---|
| 75 994 | 4/1983 | (EP) . |
| 75 995 | 4/1983 | (EP) . |
| 75 996 | 4/1983 | (EP) . |
| 106 692 | 4/1984 | (EP) . |
| 238 638 | 9/1987 | (EP) . |
| 265 203 | 4/1988 | (EP) . |
| 325 100 | 7/1989 | (EP) . |
| 325 109 | 7/1989 | (EP) . |
| 340 013 | 11/1989 | (EP) . |
| 367 339 | 5/1990 | (EP) . |
| 374 702 | 6/1990 | (EP) . |
| 384 070 | 8/1990 | (EP) . |
| 390 251 | 10/1990 | (EP) . |
| 408 965 | 1/1991 | (EP) . |
| 420 317 | 4/1991 | (EP) . |
| 487 262 | 5/1992 | (EP) . |
| 662511 | 7/1995 | (EP) . |
| 694 608 | 1/1996 | (EP) . |
| 709 449 | 5/1996 | (EP) . |
| 2 185 991 | 8/1987 | (GB) . |
| 2 185 992 | 8/1987 | (GB) . |
| 3-168298 | 7/1991 | (JP) . |
| 5-97634 | 4/1993 | (JP) . |
| 5-117138 | 5/1993 | (JP) . |
| 6-16523 | 1/1994 | (JP) . |
| 6-49482 | 2/1994 | (JP) . |
| 6-172790 | 6/1994 | (JP) . |
| WO 87/02053 | 4/1987 | (WO) . |
| WO 91/14760 | 10/1991 | (WO) . |
| WO 92/01772 | 2/1992 | (WO) . |
| WO 93/19155 | 9/1993 | (WO) . |
| WO 94/01525 | 1/1994 | (WO) . |
| WO 94/09101 | 4/1994 | (WO) . |
| WO 94/22997 | 10/1994 | (WO) . |
| WO 95/04803 | 2/1995 | (WO) . |
| WO 95/06153 | 3/1995 | (WO) . |
| WO 95/06702 | 3/1995 | (WO) . |
| WO 95/07968 | 3/1995 | (WO) . |
| WO 95/13347 | 5/1995 | (WO) . |

OTHER PUBLICATIONS

Abstract of JP 7062400 published Mar. 7, 1995.*
Maurice Porter, *Alkylpolyglucosiderfor Personal Care, Laundry and Liquid Detergent Applications*sSpecialty Chemicals, pp. 21–24.*
Derwent Abstract of EP 662 511 published Jul. 12, 1995.
Derwent Abstract of WO 91/14760 published Oct. 3, 1991.
Derwent Abstract of WO 92/01772 published Feb. 6, 1992.
Derwent Abstract of WO 95/04803 published Feb. 16, 1995.
Derwent Abstract of WO 95/06153 published Mar. 2, 1995.

(List continued on next page.)

*Primary Examiner*—Margaret Medley
(74) *Attorney, Agent, or Firm*—Rimma Mitelman

(57) ABSTRACT

Surfactant blends, processes for preparing them and particulate detergent compositions containing them.

Mobile liquid surfactant blends consisting essentially of alkyl polyglycosides and ethoxylated nonionic surfactant are provided, the surfactant blend having a viscosity at 65° C. measured at $50_s^{-1}$ not exceeding 1 Pas, the weight ratio of alkyl polyglycoside to ethoxylated nonionic surfactant being within the range of from 35.65 to 65.35, there being from 2–25% of water. Various processes for the preparation of such blends are provided. The mobile surfactant blends can be used in the preparation of particulate detergent compositions or components by mixing the blend with a particulate carrier material without requiring a drying step.

14 Claims, No Drawings

OTHER PUBLICATIONS

Derwent Abstract of WO 95/13347 published May 18, 1995.
Derwent Abstract of JP 3–168298 published Jul. 22, 1991.
Derwent Abstract of JP 5–97634 published Apr. 20, 1993.
Derwent Abstract of JP 5–117138 published May 14, 1993.
Derwent Abstract of JP 6–49482 published Feb. 22, 1994.
Derwent Abstract of JP 6–16523 published Jan. 25, 1994.
Derwent Abstract of JP 6–172790 published Jun. 21, 1994.
Derwent Abstract of EP 202 638 published Nov. 26, 1986.
Derwent Abstract of EP 370 312 published May 30, 1990.
Derwent Abstract of EP 415 192 published Mar. 6, 1991.
Derwent Abstract of EP 495 176 published Jul. 22, 1992.
Derwent Abstract of WO 94/22997 published Oct. 13, 1994.
European Search Report, in a European Patent Application 97 30 1862.*

* cited by examiner

SURFACTANT BLENDS, PROCESSES FOR PREPARING THEM AND PARTICULATE DETERGENT COMPOSITIONS CONTAINING THEM

TECHNICAL AREA

The present invention is concerned with mobile surfactant blends containing alkylpolyglycosides, processes for preparing them, their use in the preparation of particulate detergent compositions and components.

BACKGROUND

Alkylpolyglycosides have been widely disclosed in the art as environmentally friendly carbohydrate-derived nonionic surfactants, and are used in various detergent and personal care products. Disclosures in the prior art include EP 75 995A (Procter & Gamble), EP 238 638B (Staley/Henkel), EP 487 262A (Unilever) and EP 374 702 A (Kao).

These materials are currently supplied as aqueous pastes containing only about 50 wt % of active matter, the balance being water. The water is present as a result of the manufacturing process, and is also important as a medium for the subsequent hydrogen peroxide bleaching step which is always required in order to obtain a light-coloured product. For example, EP 306 650A (Hals AG) discloses a process for the preparation of alkylpolyglycosides by glycosidation in alcoholic solution, followed by purification with active charcoal, removal of the alcohol by distillation, addition of further water, and bleaching with hydrogen peroxide. The product is an aqueous paste having an active matter content of about 50 wt %.

The aqueous paste possesses a number of disadvantages. Viscosity is too high for processability at 20° C. and heating to 30° C. or above is required. If the water is surplus to the requirements of the final detergent product, it must be removed by the detergent manufacturer either before or during its incorporation.

Traditional low- and medium-density detergent powders were and are prepared by spray-drying an aqueous slurry of all ingredients that are sufficiently heat-insensitive. This is a high temperature process in which large amounts of water are driven off. In this process the water associated with the polymer is a minor contributor to the total slurry moisture and makes little or no difference to the efficiency or energy consumption of the process.

The compact or concentrated powders which now form a substantial part of the market, however, are prepared by non-tower mixing and granulation processes which generally avoid high-temperature processing where water will be driven off. In such processes it is generally desirable that the moisture content should be kept as low as possible, both to facilitate granulation, which requires a carefully controlled balance of liquid and solid ingredients, and to ensure that the final product also has as low as possible a moisture content. Low moisture content is especially important for compositions to which moisture-sensitive bleach ingredients, especially sodium percarbonate, are to be added.

Mixing and granulation may be followed by a separate drying step, for example, in a fluidised bed, but that requires additional plant and the expenditure of additional energy.

Accordingly, for the preparation of compact high bulk density powders of low moisture content, the incorporation of alkylpolyglycosides in the form of aqueous pastes is not ideal.

The present inventors have now succeeded in preparing alkylpolyglycosides in a mobile, processable form having low water content, as blends with ethoxylated nonionic surfactants and strictly controlled amounts of water. The blends may readily be mixed and granulated with detergent solids by non-spray-drying processes to form particulate detergent compositions or components of high surfactant content and low water content, no further drying step being required.

PRIOR ART

EP 75 995A and EP 75 996A (Procter & Gamble) disclose detergent compositions containing alkylpolyglycosides and ethoxylated nonionic surfactants. The combination of surfactants is said to give improved detergency on certain soils.

EP 265 203B (Unilever) discloses sprayable mobile liquid blends of anionic surfactants (alkylbenzene sulphonates or primary alcohol sulphates) and ethoxylated nonionic surfactants containing less than 10 wt % of water. The blends may be sprayed onto solid absorbent particulate carrier materials to form particulate detergent compositions.

WO 94 22997A (Henkel) discloses synergistic surfactant mixtures of alkylpolyglycosides and nonionic surfactants.

EP 662 511A (Huls) relates to the use of nonionic surfactants to liquefy the hexagonal liquid crystalline phase of surfactant mixtures, and discloses isotropic liquid surfactant mixtures of alkylpolyglycosides, ethoxylated nonionic surfactants and water.

WO 93 19155A (Henkel) discloses the production of granular detergent compositions or components from aqueous alkylpolyglycoside pastes: the pastes are dried and granulated with a cosurfactant (which may be nonionic) and with solid detergent ingredients in a turbo-dryer, to give a granular product having a high alkylpolyglycoside content and a low water content.

EP 694 608A (Procter & Gamble) discloses the production of granular laundry detergent compositions or components containing a polyhydroxy fatty acid amide sugar surfactant. A pumpable premix of the sugar surfactant with ethoxylated nonionic surfactant and a glyceride fat is prepared and then mixed and granulated with solid detergent ingredients, for example, zeolite or sodium citrate, to form the desired granular product.

DEFINITION OF THE INVENTION

In its first aspect, the present invention provides a mobile liquid surfactant blend having a viscosity at 65° C., measured at 50 $s^{-1}$, not exceeding 1 Pas, the blend consisting essentially of an alkylpolyglycoside and an ethoxylated nonionic surfactant in a ratio within the range of from 35:65 to 65:35 and from 2 to 25 wt % water.

In its second aspect, the invention provides various processes for the preparation of this blend.

In its third aspect, the present invention provides a process for the preparation of a particulate detergent composition or component which comprises mixing a surfactant blend as defined in the previous paragraph with a particulate carrier material.

In its fourth aspect, the present invention provides a detergent granule consisting essentially of alkylpolyglycoside, ethoxylated nonionic surfactant and one or more detergent-functional inorganic salts, having a total content of alkylpolyglycoside and ethoxylated nonionic surfactant of at least 20 wt %, a ratio of alkylpolyglycoside to ethoxylated nonionic surfactant within the range of from 35:65 to 65:35, and a water content not exceeding 20 wt %.

In its fifth aspect, the present invention provides the use of a mobile surfactant blend having a viscosity at 65° C., measured at 50 $s^{-1}$, not exceeding 1 Pas, consisting essentially of an alkylpolyglycoside and an ethoxylated nonionic surfactant in a ratio within the range of from 35:65 to 65:35 and from 2 to 25 wt % water, to prepare a particulate detergent composition or component having a water content not exceeding 20 wt %.

DETAILED DESCRIPTION OF THE INVENTION

The Alkyltolyplycoside

Alkylpolyglycosides may be represented by the general formula I $$RO(R'O)_t(G)_x \quad (I)$$

in which R is an organic hydrophobic residue containing from 10 to 20 carbon atoms, R' is an alkylene group containing from 2 to 4 carbon atoms, G is a saccharide residue containing 5 or 6 carbon atoms, t is in the range of from 0 to 25 and x is in the range of from 1 to 10.

The hydrophobic group R may be aliphatic, either saturated or unsaturated, notably linear or branched alkyl, alkenyl, hydroxyalkyl or hydroxyalkenyl. However, it may include an aryl group for example alkyl-aryl, alkenyl-aryl and hydroxyalkyl-aryl. The preferred R group is an alkyl or alkenyl group having from 8 to 20 carbon atoms, more preferably from 8 to 16 carbon atoms. The most preferred R group is an alkyl group having from 12 to 14 carbon atoms.

The value of t in the general formula above is preferably zero, so that the $-(RO)_t-$ unit of the general formula is absent. In that case the general formula becomes $$RO(G)_x \quad (II)$$

If t is non-zero it is preferred that R'O is an ethylene oxide residue. Other likely possibilities are propylene oxide and glycerol residues. If the parameter t is non-zero so that R'O is present, the value of t (which may be an average value) will preferably lie in the range of from 0.5 to 10.

The group G is typically derived from fructose, glucose, mannose, galactose, talose, gulose, allose, altrose, idose, arabinose, xylose, lyxose and/or ribose. Preferably, the group G is provided substantially exclusively by glucose units.

The value x, which is an average, is usually termed the degree of polymerisation (dp). Desirably x is within the range of from 1 to 8. Preferred values of x lie within the range of from 1 to 3, especially from 1 to 1.8 and more especially from 1 to 1.6.

When x lies in the range 1 to 1.6 it is preferred that R is $C_8$ to $C_{14}$ alkyl or alkenyl. In especially preferred materials, R is $C_8$ to $C_{14}$ alkyl or alkenyl, t is zero, and x is within the range of from 1 to 1.6.

Commercially available products suitable for use in the compositions of the invention include Plantaren (Trade Mark) 600 and 650 CS UP ($C_{12}$–$C_{14}$ alkyl, dp 1.4), ex Henkel KGaA; Lutensol (Trade Mark) GD 70 ex BASF; Marlosan (Trade Mark) 24 ex Hüls; and Atlas (Trade Mark) G73500 ex ICI.

The Ethoxylated Nonionic Surfactant

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol.

The surfactant blend

The surfactant blend of the invention consists essentially of alkylpolyglycoside, ethoxylated nonionic surfactant, and water. It is essential that the water content does not exceed 25 wt %. The water content may range from 2 to 25 wt %, preferably from 5 to 20 wt %.

The surfactant blend of the invention is mobile at convenient processing temperatures, that is to say, at 65° C., and preferably at lower temperatures, its viscosity measured at a shear rate of 50 $s^{-1}$ does not exceed 1 Pas. Thus, the blends according to the invention have a critical temperature $T_c$, below which the viscosity at 50 $s^{-1}$ exceeds 1 Pas, not exceeding 65° C., preferably not exceeding 50° C. and most preferably not exceeding 45° C. It is not essential that the blends be homogeneous isotropic liquids at these temperatures, provided that they can readily be homogenised.

The ratio of alkylpolyglycoside to ethoxylated nonionic surfactant is within the range of from 35:65 to 65:35, and is preferably within the range of from 45:55 to 60:40.

The amount of ethoxylated nonionic surfactant in the blends of the invention always exceeds the amount of water. The ratio of ethoxylated nonionic surfactant to water in the blends of the invention is preferably within the range of from 90:10 to 60:40, more preferably from 85:15 to 60:40.

Preferred blends in accordance with the invention consist essentially of:

(i) from 20 to 60 wt % of alkylpolyglycoside, (ii) from 30 to 60 wt % of ethoxylated nonionic surfactant, (iii) from 2 to 25 wt % of water.

Especially preferred blends in accordance with the invention consist essentially of:

(i) from 36 to 50 wt % of alkylpolyglycoside, (ii) from 30 to 50 wt % of ethoxylated nonionic surfactant, (iii) from 5 to 20 wt % of water.

Very minor amounts of other compatible ingredients may be present provided that they do not interfere with the phase behaviour of the blend. However, preferred blends are substantially free of other ingredients other than in trace amounts.

Preparation of the Blends

Various methods have been developed for the preparation of the surfactant blends of the invention.

A problem with alkylpolyglycosides is their tendency to discolour, especially if subjected to elevated temperatures. As indicated previously, the final stage in the product of the commercially available aqueous pastes is normally a bleaching step with aqueous hydrogen peroxide, a process which obviously requires an aqueous environment. Subsequent drying will tend to produce discoloration. The present inventors have derived various methods for producing surfactant blends of low water content without sacrificing good colour.

The blends may simply be prepared by mixing concentrated alkylpolyglycoside (prepared, for example, by distillation or vacuum drying), ethoxylated nonionic surfactant and water in the requisite proportions, preferably in a ratio of ethoxylated nonionic surfactant to total water of from 90:10 to 60:40. The active matter content of the concentrated alkylpolyglycoside should be at least 55 wt %, preferably at least 75 wt % and more preferably at least 95 wt %. The content of water or other diluent should be less than 45 wt %, preferably less than 25 wt % and more preferably less than 5 wt %.

In order for adequate mixing to be achieved, this mixing process also requires an elevated temperature—generally 80 to 115° C., preferably 90 to 110° C.—and the resulting product will generally require a further bleaching step.

Bleaching may be carried out using 30% aqueous hydrogen peroxide at a temperature of from 80 to 100° C. Preferably, prior to bleaching, the water content should be no greater than about 8 wt % to compensate for the additional water introduced by the bleaching step, and to prevent excessive foaming.

Thus a first process of the invention for the preparation of the surfactant blends of the invention comprises the steps of (i) mixing a concentrated alkylpolyglycoside material having an active matter content of at least 55 wt %, preferably at least 75 wt %, with ethoxylated nonionic surfactant and water, with stirring at an elevated temperature, and (ii) optionally subsequently bleaching the resulting alkylpolyglycoside/ethoxylated nonionic surfactant/water blend with aqueous hydrogen peroxide, the components being mixed in step (i) in proportions such that the ratio of alkylpolyglycoside to ethoxylated nonionic surfactant is within the range of from 35:65 to 65:35 and the ratio of ethoxylated nonionic surfactant to total water, after any bleaching step (ii), is within the range of from 90:10 to 60:40.

A second process according to the invention utilises both dried alkylpolyglycoside and paste in order the achieve the correct phase ratio. The second process comprises the steps of (i) mixing a concentrated alkylpolyglycoside material having an active matter content of at least 55 wt %, preferably at least 75 wt %, an aqueous paste of alkylpolyglycoside, and ethoxylated nonionic surfactant, with stirring at an elevated temperature, and (ii) optionally subsequently bleaching the resulting alkylpolyglycoside/ethoxylated nonionic surfactant/water blend with aqueous hydrogen peroxide, the components being mixed in step (i) in proportions such that the ratio of alkylpolyglycoside to ethoxylated nonionic surfactant is within the range of from 35:65 to 65:35 and the ratio of ethoxylated nonionic surfactant to total water, after any bleaching step (ii), is within the range of from 90:10 to 60:40.

The mixing temperatures required are similar to those for the first process: generally 80 to 115° C., preferably 90 to 110° C. Bleaching may be carried out in the same way. As in the first process, prior to any bleaching step the water content should be selected to ensure the correct phase ratio in view of the additional water introduced by the bleaching step, and to prevent excessive foaming.

Both the first and the second processes may require a bleaching step because of the use of the concentrated alkylpolyglycoside. A third process has been identified in which the (already bleached) aqueous paste is used as sole alkylpolyglycoside raw material and no elevated temperatures are required: this process utilises the principle of salting out.

This third process thus comprises the steps of (i) mixing an aqueous alkylpolyglycoside paste, an ethoxylated nonionic surfactant and a solid water-soluble inorganic salt, (ii) allowing the resulting mixture to separate into a first, organic-rich phase and a second, water-rich phase, (iii) separating out the organic phase containing alkylpolyglycoside, ethoxylated nonionic surfactant and water, the proportions of the alkylpolyglycoside paste and ethoxylated nonionic surfactant mixed in step (i) being chosen such that, in the organic phase obtained in step (iii), the ratio of alkylpolyglycoside to ethoxylated nonionic surfactant is within the range of from 35:65 to 65:35 and the ratio of ethoxylated nonionic surfactant to total water is within the range of from 90:10 to 60:40.

This process can generally be conducted at temperatures not higher than about 60° C. Preferred temperatures are within the range of from 50 to 70° C. The only limitation on the temperature is that it must be sufficiently high for the aqueous alkylpolyglycoside paste to be liquid, and it must be above the cloud point of the ethoxylated nonionic surfactant. This process therefore has the major advantage that no further bleaching step is required.

Preparation of Detergent Compositions and Components

The invention also encompasses the use of the surfactant blends defined and described above to prepare granular and particulate detergent compositions and components of low moisture content, not exceeding 20 wt %. The use of these blends allows alkylpolyglycosides and nonionic surfactants to be incorporated in low-moisture-content particulate detergent compositions without the need for additional drying steps.

According to the invention, the surfactant blend, and optionally other surfactants, is mixed with one or more particulate carrier materials, including one or more inorganic salts, to produce a granular or particulate product. The product thus obtained may range from a detergent base powder containing significant amounts of other functional ingredients, for example, other surfactants and builders, which will form a substantial proportion, for example at least 40 wt %, typically 50 to 99 wt %, of a final detergent product, to an adjunct granule consisting essentially of the surfactant blend and a carrier material, having a high surfactant loading and generally destined to constitute a relatively minor proportion of a final detergent product.

In both cases, the carrier material will generally comprise one or more detergent-functional inorganic salts. Suitable salts include alkali metal aluminosilicates (zeolites), phosphates, carbonates, sulphates and combinations of these.

The carrier material may, for example, be a porous spray-dried material and the surfactant blend may be applied by spraying at a temperature at which its viscosity is sufficiently low.

However, the present invention is directed especially at the preparation of high bulk density compact particulate detergent compositions by non-spray-drying (non-tower) processes.

The surfactant blends of the invention allow the preparation of high bulk density detergent granules (both base powders and adjuncts) having low moisture content to be effected in a single mixing and granulating step without the need for a subsequent drying step.

A preferred process according to the invention therefore comprises granulating the surfactant blend of the invention with one or more detergent-functional inorganic salts, and optionally other detergent ingredients.

This process may, for example, be carried out in a high-speed mixer/granulator, either continuous or batch, for example, a Lödige (Trade Mark) CB Recycler (continuous) or a Fukae (Trade Mark) mixer (batch). Processes using high-speed mixer/granulators are disclosed, for example, in EP 340 013A, EP 367 339A, EP 390 251A and EP 420 317A (Unilever). These processes are equally suitable for the production of detergent base powders and of adjunct granules.

The Detergent Granule

An especially preferred embodiment of the invention is a detergent granule or adjunct granule, characterised by a high total content of surfactant (alkylpolyglycoside and ethoxylated nonionic surfactant) as well as by a low moisture content. The total surfactant amounts to at least 20 wt %, preferably at least 25 wt % and more preferably at least 30 wt %. The total surfactant content is suitably from 20 to 55 wt %, preferably from 25 to 40 wt %.

The content of alkylpolyglycoside is also high: preferably at least 10 wt % and more preferably at least 15 wt %.

As in the blend from which it is made, the ratio of alkylpolyglycoside to ethoxylated nonionic surfactant in the granule is within the range of from 35:65 to 65:35, and preferably within the range of from 45:55 to 60:40.

As previously indicated, the detergent granule is also characterised by a water content not exceeding 20 wt %, preferably not exceeding 15 wt %. The water content is desirably as low as possible, and may typically range from 2 to 20 wt %, preferably from 2 to 15 wt %.

Alternatively, the moisture content may be expressed in terms of the relative humidity of air at 1 atmosphere and 20° C. in equilibrium with the composition. The detergent granules of the invention preferably have a relative humidity value not exceeding 50%, and preferably not exceeding 45%. Typically the relative humidity value ranges from 10 to 50%, preferably from 10 to 45%.

The detergent granules preferably have a bulk density of at least 600 g/litre, more preferably at least 650 g/litre and most preferably at least 700 g/litre.

Preferred detergent granule compositions are as follows:

(i) from 10 to 30 wt % of alkylpolyglycoside, (ii) from 10 to 25 wt % of ethoxylated nonionic surfactant, (iii) from 40 to 75 wt % of detergent-functional inorganic salts, and (iv) from 2 to 20 wt % of water.

Especially preferred detergent granule compositions are as follows:

(i) from 15 to 20 wt % of alkylpolyglycoside, (ii) from 10 to 20 wt % of ethoxylated nonionic surfactant, (iii) from 50 to 65 wt % of detergent-functional inorganic salts, and (iv) from 2 to 15 wt % of water.

According to a preferred embodiment of the invention the detergent-functional inorganic salts comprise zeolite and/or sodium carbonate. Either salt may be used alone, but especially preferred granules contain zeolite and carbonate in a ratio of from 1:10 to 10:1, more preferably from 1:1 to 10:1.

The zeolite may be the commercially available zeolite 4A now widely used in laundry detergent powders. However, according to a preferred embodiment of the invention, the zeolite is maximum aluminium zeolite P (zeolite MAP) as described and claimed in EP 384 070B (Unilever). Zeolite MAP is defined as an alkali metal aluminosilicate of the zeolite P type having a silicon to aluminium ratio not exceeding 1.33, preferably within the range of from 0.90 to 1.33, and more preferably within the range of from 0.90 to 1.20. Especially preferred is zeolite MAP having a silicon to aluminium ratio not exceeding 1.07, more preferably about 1.00. The calcium binding capacity of zeolite MAP is generally at least 150 mg CaO per g of anhydrous material.

The preferred form of sodium carbonate is light soda ash.

Some typical preferred detergent granules according to the present invention may have the following compositions:

Zeolite/carbonate (i) from 15 to 20 wt % of alkylpolyglycoside, (ii) from 10 to 20 wt % of ethoxylated nonionic surfactant, (iii) from 20 to 55 wt % of zeolite, (iv) from 5 to 50 wt % of sodium carbonate, (iv) from 5 to 15 wt % of water.

Zeolite alone (i) from 15 to 25 wt % of alkylpolyglycoside, (ii) from 10 to 20 wt % of ethoxylated nonionic surfactant, (iii) from 40 to 60 wt % of zeolite, (iv) from 2 to 15 wt % of water.

Carbonate alone (i) from 15 to 20 wt % of alkylpolyglycoside, (ii) from 10 to 20 wt % of ethoxylated nonionic surfactant, (iii) from 40 to 70 wt % of sodium carbonate, (iv) from 2 to 10 wt % of water.

The detergent granules of the invention, containing high levels of alkylpolyglycoside and ethoxylated nonionic surfactant, plus carrier salts and moisture, may be regarded as simple detergent compositions in their own right but, as previously explained, they will more normally be admixed with other granular materials to form more complex compositions. The granules exhibit excellent granulometry and are highly suitably for admixture with other granules and ingredients to produce a final composition.

Detergent Base Powders

As previously indicated, the surfactant blends of the present invention may also be used to prepare detergent base powders which differ from the adjunct granules just described in containing a lower proportion of alkylpolyglycoside and nonionic surfactant, but significant levels of other functional ingredients. In a detergent powder which is a mixture a number of granular or particulate ingredients, the term base powder is normally used for the granule present in the highest amount, typically 40 to 99 wt % of the final product. The base powder always contains at least one surfactant and at least one builder and/or inorganic salt.

Preferred ingredients in the base powder include other anionic and/or nonionic surfactants, for example, primary alcohol sulphates and/or linear alkylbenzene sulphonates, additional ethoxylated and non-ethoxylated nonionic surfactants; inorganic and/or organic builders; antiredeposition, soil release or anti-dye-transfer polymers; fluorescers; and further inorganic salts. More details of such materials are given below under "Detergent Compositions".

The processes described above for preparing adjunct granules are equally suitable for the preparation of base powders, but are carried out in the presence of additional surfactants, builders, salts and other materials.

Like the adjunct granules of the invention, the base powders incorporating the surfactant blends of the invention are characterised by a low water content, and no additional drying step is required as a consequence of the incorporation of alkylpolyglycoside in order to achieve this. The base powder has a water content not exceeding 20 wt %, preferably not exceeding 15 wt %. The water content is desirably as low as possible, and may typically range from 2 to 20 wt %, preferably from 2 to 15 wt %.

Alternatively, the moisture content may be expressed in terms of the relative humidity of air at 1 atmosphere and 20° C. in equilibrium with the composition. The base powder preferably has a relative humidity value not exceeding 50%, and preferably not exceeding 45%. Typically the relative humidity value ranges from 10 to 50%, preferably from 10 to 45%.

The base powder preferably have a bulk density of at least 600 g/litre, more preferably at least 650 g/litre and most preferably at least 700 g/litre.

Base powders of the invention may typically contain from 1 to 10 wt % of alkylpolyglycoside.

Particulate Detergent Compositions,

Particulate detergent compositions according to the invention will comprise a number of different granules or particles, and in totality will comprise detergent-active compounds, detergency builders, and optionally bleaching components, enzymes and other active ingredients to enhance performance and properties.

As well as base powder or adjunct granules of the invention containing alkylpolyglycosides and ethoxylated nonionic surfactants, other surfactant-containing granules may be present. Many suitable detergent-active compounds are available and are fully described in the literature, for example, in "Surface-Active Agents and Detergents", Volumes I and II, by Schwartz, Perry and Berch.

Compositions of the invention preferably contain non-soap anionic surfactants. Anionic surfactants are well-known to those skilled in the art. Examples include alkylbenzene sulphonates, particularly linear alkylbenzene sulphonates having an alkyl chain length of $C_8$–$C_{15}$; primary and secondary alkylsulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

The compositions may also, if desired, contain fatty acid soap.

The total amount of surfactant present in the final composition is suitably from 5 to 60 wt %, preferably from 5 to 40 wt %.

The amount of alkylpolyglycoside present, based on the final composition, may vary widely but will suitably range from 1 to 30 wt %. The amount of ethoxylated nonionic surfactant present, based on the final composition, may suitably range from 1 to 30 wt %.

The detergent compositions of the invention will also contain one or more detergency builders. These will generally be incorporated, at least in part, via the base powder or adjunct granules of the present invention. The total amount of detergency builder in the compositions will suitably range from 5 to 80 wt %, preferably from 10 to 60 wt %.

As well as the zeolite and sodium carbonate already mentioned, inorganic builders that may be present include layered silicates as disclosed in EP 164 514B (Hoechst), and phosphates, for example, sodium orthophosphate, pyrophosphate and tripolyphosphate.

Zeolite is preferably present in a total amount of from 10 to 70% by weight (anhydrous basis), preferably from 25 to 50 wt %, based on the final composition.

Sodium carbonate is preferably present in a total amount ranging from 1 to 60 wt %, preferably from 2 to 40 wt %.

If desired, supplementary organic builders may also be present, for example, polycarboxylate polymers such as polyacrylates and acrylic/maleic copolymers, suitably used in amounts of from 0.5 to 15 wt %, preferably from 1 to 10 wt %; or monomeric polycarboxylates such as citrates, suitably used in amounts of from 5 to 30 wt %, preferably from 10 to 25 wt %. Builders, both inorganic and organic, are preferably present in alkali metal salt, especially sodium salt, form.

Detergent compositions according to the invention may also suitably contain a bleach system. This will generally comprise a peroxy bleach compound, for example, an inorganic persalt or an organic peroxyacid, capable of yielding hydrogen peroxide in aqueous solution. Preferred inorganic persalts are sodium perborate monohydrate and tetrahydrate, and sodium percarbonate. The peroxy bleach compound is suitably present in an amount of from 5 to 35 wt %, preferably from 10 to 25 wt %. The invention is especially applicable to compositions containing sodium percarbonate which is notoriously moisture-sensitive.

The peroxy bleach compound may be used in conjunction with a bleach activator (bleach precursor) to improve bleaching action at low wash temperatures, suitably present in an amount of from 1 to 8 wt %, preferably from 2 to 5 wt %. An especially preferred bleach precursor is N,N,N',N'-tetracetyl ethylenediamine (TAED).

Other materials that may be present in detergent compositions of the invention include sodium silicate; antiredeposition agents such as cellulosic polymers; fluorescers; foam control agents; detergent enzymes (proteases, lipases, amylases and cellulases); dyes; coloured speckles; perfumes; and fabric softeners.

The present invention has been defined and described above specifically in relation to alkylpolyglycosides. However, the invention is also applicable to other sugar surfactants, for example, aldobionamides (eg lactobionamides), glycolipids (eg sophorose lipids and rhamnolipids), and polyhydroxy fatty acid amides (eg N-methyl glucamides).

EXAMPLES

The invention is further illustrated by the following non-limiting Examples, in which parts and percentages are by weight unless otherwise stated. The following abbreviations are used for ingredients used in the Examples:

APG alkylpolyglycoside of dp (x value) 1.4: Plantaren (Trade Mark) 600 CS UP ex Henkel (supplied as 51.7 wt % aqueous paste)

NI Oxo $C_{12-15}$ alcohol ethoxylated with an average of 7 moles of ethylene oxide per mole: Synperonic (Trade Mark) A7 ex ICI;

Zeolite MAP Zeolite MAP as described in EP 384 070B (Unilever): Doucil (Trade Mark) A24 ex Crosfield Chemicals;

Carbonate Sodium carbonate: light soda ash ex Solvay.

Examples 1 to 3

SURFACTANT BLENDS

Surfactant blends were prepared to the following formulations:

| Example | 1 | 2 | 3 |
|---|---|---|---|
| APG | 43.5 | 46.5 | 49.0 |
| NI | 37.5 | 40.0 | 42.0 |
| Water | 19.0 | 13.5 | 9.0 |

Example 1

(43.5/37.5/19.0)

The blend was prepared by the first process of the invention. The commercial 51.7 wt % APG paste was dried by vacuum drying to a water content of 2.5 wt %, then 48.5 g of the dried material were mixed with NI (40.9 g) and water (13.6 g) under reflux and with stirring at a temperature of 90 to 105° C. The resulting APG:NI ratio was 54:46, and the NI:water ratio was 72:28. This blend was then bleached with 30% aqueous hydrogen peroxide (6 ml was added in two steps to prevent excess foaming) for 1 hour at 80–100° C. The NI:water ratio after this addition was 65:35.

Klett colours (measured in 10 wt % ethanol/water at an APG concentration of 5 wt %) were as follows (pure white is zero):

| | |
|---|---|
| Commercial APG paste | 115 |
| Concentrated APG (2.5% water) | 305 |
| Blend before bleaching | 230 |
| Blend after bleaching | 45 |
| Bleached blend after 24 h storage at 80° C. | 145 |

This shows that even after severe storage testing the colour of the blend according to the invention remained acceptable.

Example 2

(46.5/40.0/13.5)

Example 2 was prepared by the second process of the invention. A commercial 51.7 wt % APG paste was dried by vacuum drying to a water content of 2.5 wt %. Then a mixture was made of 420 g of this material, 280 g of the commercial APG paste and 486 g NI, under reflux and with stirring at 100 to 105° C. The resulting APG:NI ratio was 53:47, and the NI:water ratio was 77:23. This mixture was allowed to cool to 90° C. and was then bleached with 35 ml of a 30% aqueous hydrogen peroxide, which was added very slowly to prevent excess foaming. The NI:water ratio after this addition was 74:26. The Klett colour of the surfactant paste was 68. After 4 days' storage at 90° C. its Klett colour was 128.

After 4 days' storage at 90° C. the blend consisted of a thin low-viscosity liquid (90 wt %) above an easily dispersible layer of solids (10 wt %).

The critical temperature $T_c$, below which the viscosity of the blend exceeded 1 Pas at 50 $s^{-1}$, was 47° C. Above 80° C. at this shear rate the viscosity remained below 100 mPas.

The following viscosities were measured at temperatures from 45 to 90° C. and shear rates of from 50 to 390 $s^{-1}$:

| Temperature (° C.) | Viscosity (mPas) |
|---|---|
| 90 | 100–60 |
| 75 | 150–100 |
| 60 | 250–200 |
| 47 | 1000–400 |

Example 3

(49.0/42.0/9.0)

Example 3 was prepared by reducing the water content of the final surfactant blend of Example 2 to 9% by distillation. In this process the blend colour deteriorated to Klett 240. Bleaching with 5 ml of 30% aqueous hydrogen peroxide restored the colour to Klett 86.

Klett colours were as follows:

Blend after bleaching 86

Bleached blend after 4 days' storage at 90° C. 181

After 4 days' storage at 90° C. the blend consisted of a thin low-viscosity liquid (80 wt %) over an easily dispersible layer of solids, and could readily be homogenised.

The critical temperature $T_c$, below which the viscosity of the blend exceeded 1 Pas at 50$s^{-1}$ was 38° C. Above 70° C. at this shear rate the viscosity remained below 200 mpas.

The following viscosities were measured at temperatures from 45 to 90° C. and shear rates of from 50 to 390 $s^{-1}$

| Temperature (° C.) | Viscosity (mPas) |
|---|---|
| 90 | 70–50 |
| 75 | 140–110 |
| 60 | 300–240 |
| 45 | 1000–700 |

EXAMPLES 4 to 12 and COMPARATIVE EXAMPLES A to C: SURFACTANT/ZEOLITE/CARBONATE GRANULES Granules were prepared to the formulations shown in the following Tables.

For Examples 4 to 6, the blend of Example 1 was used.

For Examples 7 to 9, the blend of Example 2 was used.

For Examples 10 to 12, the blend of Example 3 was used.

For Comparative Examples A to C, the commercially available paste consisting of 51.7 wt % APG and 48.3 wt % water was used.

The surfactant blends or pastes were mixed with zeolite MAP and sodium carbonate in a high speed laboratory scale blender, using a tip speed of 15–30 $ms^{-1}$.

The higher surfactant content and lower moisture content and relative humidity values of the compositions of the invention will be noted.

EXAMPLES 4 to 6, COMPARATIVE EXAMPLES A to C

| | Blend of Example 1 | | | APG/water paste | | |
|---|---|---|---|---|---|---|
| Example | 4 | 5 | 6 | A | B | C |
| Carrier granule composition (wt %) | | | | | | |
| Zeolite MAP (as is) | 75.0 | 80.0 | 85.0 | 75.0 | 80.0 | 90.0 |
| Carbonate | 25.0 | 20.0 | 15.0 | 25.0 | 20.0 | 10.0 |
| Composition of final granules (g) | | | | | | |
| Surfactant blend/paste | 30.8 | 29.4 | 31.1 | 55.4 | 51.0 | 55.4 |
| Zeolite MAP (as is) | 37.5 | 40.0 | 42.5 | 75.0 | 80.0 | 90.0 |
| Carbonate | 12.5 | 10.0 | 7.5 | 25.0 | 20.0 | 10.0 |
| Total | 80.8 | 79.4 | 81.1 | 155.4 | 151.0 | 155.4 |

-continued

| Composition of final granules (wt %) | | | | | | |
|---|---|---|---|---|---|---|
| APG | 16.6 | 16.1 | 16.7 | 18.4 | 17.5 | 18.4 |
| NI | 14.3 | 13.9 | 14.4 | — | — | — |
| Water | 12.3 | 12.6 | 13.1 | 22.0 | 21.6 | 23.0 |
| Zeolite MAP (as anhydrous) | 41.3 | 44.8 | 46.6 | 43.4 | 47.7 | 52.1 |
| Carbonate | 15.5 | 12.6 | 9.2 | 16.1 | 13.2 | 6.4 |
| Total surfactant (wt %) | 30.9 | 30.0 | 31.1 | 18.4 | 17.5 | 18.4 |
| Relative humidity (%) | 43 | 30 | 25 | 63 | 65 | 75 |
| Bulk density (g/litre) | 700 | 780 | 770 | — | — | — |

EXAMPLES 7 to 12

| | Blend of Example 2 | | | Blend of Example 3 | | |
|---|---|---|---|---|---|---|
| Example | 7 | 8 | 9 | 10 | 11 | 12 |
| Carrier granule composition (wt %) | | | | | | |
| Zeolite MAP (as is) | 100.0 | 75.0 | — | 100.0 | 75.0 | — |
| Carbonate | — | 25.0 | 100.0 | — | 25.0 | 100.0 |
| Composition of final granules (g) | | | | | | |
| Surfactant blend/paste | 42.2 | 37.0 | 30.0 | 34.3 | 31.5 | 29.9 |
| Zeolite MAP (as is) | 60.2 | 44.3 | — | 55.0 | 41.3 | — |
| Carbonate | — | 15.1 | 50.0 | — | 13.8 | 55.0 |
| Total | 102.4 | 96.3 | 80.0 | 89.3 | 86.6 | 84.9 |
| Composition of final granules (wt %) | | | | | | |
| APG | 20.2 | 18.8 | 18.4 | 18.0 | 17.1 | 16.6 |
| NI | 17.3 | 16.1 | 15.8 | 15.4 | 14.6 | 14.1 |
| Water | 10.2 | 8.5 | 3.4 | 11.8 | 9.9 | 4.5 |
| Zeolite MAP (as anhydrous) | 52.3 | 40.9 | — | 54.8 | 42.4 | — |
| Carbonate | — | 15.7 | 62.4 | — | 16.0 | 64.8 |
| Total surfactant (wt %) | 37.5 | 34.9 | 34.2 | 33.4 | 31.7 | 30.7 |
| Relative humidity (%) | 15 | 16 | 49 | 19 | 20 | 51 |
| Bulk density (g/litre) | 710 | 710 | 660 | 820 | 850 | 670 |

What is claim is:

1. A mobile liquid surfactant blend having a viscosity at 65° C., measured at a shear rate of 50 $s^{-1}$, not exceeding 1 Pas, and having a critical temperature $T_c$ below which the viscosity at 50 $s^{-1}$ exceeds 1 Pas not exceeding 50° C., the blend consisting essentially of (i) from 20 to 60 wt % of an alkylpolyglycoside, (ii) from of an ethoxylated nonionic surfactant, and (iii) water, the weight ratio of the alkylpolyglycoside to the ethoxylated nonionic surfactant being from 35:65 to 65:35 and the weight ratio of the ethoxylated nonionic surfactant to water being within the range of from 90:10 to 60:40.

2. A surfactant blend as claimed in claim 1, which consists essentially of:

(i) from 36 to 60 wt % of the alkylpolyglycoside, (ii) from 30 to 50 wt % of the ethoxylated nonionic surfactant, (iii) from 5 to 20 wt % of water.

3. A surfactant blend as claimed in claim 1, wherein the alkylpolyglycoside has the general formula I $$RO(R'O)_t(G)_x \quad (I)$$

in which R is an organic hydrophobic residue containing from 10 to 20 carbon atoms, R' is an alkylene group containing from 2 to 4 carbon atoms, G is a saccharide residue containing 5 or 6 carbon atoms, t is in the range of from 0 to 25 and x is in the range of from 1 to 10.

4. A surfactant blend as claimed in claim 3, wherein the alkylpolyglycoside has the general formula I wherein R is $C_8$ to $C_{14}$ alkyl or alkenyl, t is zero and x lies within the range of from 1 to 1.6.

5. A surfactant blend as claimed in claim 1, wherein the ethoxylated alcohol nonionic surfactant is a $C_{10}$–$C_{15}$ primary or secondary aliphatic alcohol ethoxylated with an average of from 1 to 10 moles of ethylene oxide per mole of alcohol.

6. A process for the preparation of a surfactant blend as claimed in claim 1, which comprises the steps of (i) mixing a concentrated alkylpolyglycoside material containing at least 55 wt % alkylpolyglycoside with ethoxylated nonionic surfactant and water, with stirring at a temperature within the range of from 80 to 115° C., and (ii) optionally subsequently bleaching the resulting alkylpolyglycosidelethoxylated nonionic surfactant/water blend with aqueous hydrogen peroxide, the components being mixed in step (i) in proportions such that the ratio of alkylpolyglycoside to ethoxylated nonionic surfactant is within the range of from 35:65 to 65:35 and the ratio of ethoxylated nonionic surfactant to total water, after any bleaching step (ii), is within the range of from 90:10 to 60:40.

7. A process for the preparation of a surfactant blend as claimed in claim 1, which comprises the steps of (i) mixing a concentrated alkylpolyglycoside material containing at least 55 wt % alkylpolyglycoside, an aqueous alkylpolyglycoside paste, and ethoxylated nonionic surfactant, with stirring at a temperature within the range of from 80 to 115° C., and (ii) optionally subsequently bleaching the resulting alkylpolyglycoside/ethoxylated nonionic surfactant/water blend with aqueous hydrogen peroxide, the components being mixed in step (i) in proportions such that the ratio of alkylpolyglycoside to ethoxylated nonionic surfactant is within the range of from 35:65 to 65:35 and the ratio of ethoxylated nonionic surfactant to total water, after any bleaching step (ii), is within the range of from 90:10 to 60:40.

8. A process for the preparation of a surfactant blend as claimed in claim 1, which comprises the steps of (i) mixing an aqueous alkylpolyglycoside paste, ethoxylated nonionic surfactant and a solid water-soluble inorganic salt, (ii) allowing the resulting mixture to separate into a first, organic-rich phase and a second, water-rich phase, (iii) separating out the organic phase containing alkylpolyglycoside, ethoxylated nonionic surfactant and water, the components being mixed in step (i) in proportions such that the ratio of alkylpolyglycoside to ethoxylated nonionic surfactant is within the range of from 35:65 to 65:35 and the ratio of ethoxylated nonionic surfactant to water in the organic phase obtained in step (iii) is within the range of from 90:10 to 60:40.

9. A process for the preparation of a particulate or granular detergent composition or component which comprises mixing a surfactant blend as claimed in claim 1 with one or more particulate carrier materials comprising one or more detergent-functional inorganic salts.

10. A detergent granule consisting essentially of (i) from 10 to 30 wt % of an alkylpolyglycoside, (ii) of an ethoxylated nonionic surfactant, (iii) from 40 to 75 wt % of detergent-functional inorganic salts, (iv) from 2 to 20 wt % of water, the granule having a total content of the alkylpolyglycoside and the ethoxylated nonionic surfactant of at least 30 wt % and a ratio of the alkylpolyglycoside to the ethoxylated nonionic surfactant within the range of from 35:65 to 65:35.

11. A detergent granule as claimed in claim 10, wherein the ratio of alkylpolyglycoside to ethoxylated nonionic surfactant is within the range of from 45:55 to 60:40.

12. A detergent granule as claimed in claim 10, having a water content not exceeding 15 wt %.

13. A detergent granule as claimed in claim 10, wherein the detergent-functional inorganic salts comprise zeolite and/or sodium carbonate.

14. A detergent granule as claimed in claim 13, wherein the detergent-functional inorganic salts comprise zeolite and sodium carbonate in a ratio of from 1:10 to 10:1.

* * * * *